US006148881A

United States Patent [19]

Valenzuela

[11] Patent Number: 6,148,881

[45] Date of Patent: Nov. 21, 2000

[54] WORKBENCH

[76] Inventor: Carlos Martin Uribe Valenzuela, Calle 67 No 4A - 70 Piso 3, Santafe De Bogota, D.C., Colombia

[21] Appl. No.: 09/163,386

[22] Filed: Sep. 30, 1998

[30] Foreign Application Priority Data

Oct. 8, 1997 [CO] Colombia ..... 97058795

[51] Int. Cl.[7] ..... B25H 1/00

[52] U.S. Cl. ..... 144/286.1; 29/26 A; 144/1.1; 144/286 A; 144/307; 144/308; 108/11; 108/28; 269/16; 269/900; 269/901; 269/88; 408/236

[58] Field of Search ..... 144/1.1, 286.1, 144/286.5, 287; 269/289 R, 290, 292–295, 900, 901, 16, 307, 88; 408/234, 237, 239 A, 336; 29/26 R, 26 A, 26 B, 27 R, 28; 108/11, 28, 153, 50

[56] References Cited

U.S. PATENT DOCUMENTS

| | | | |
|---|---|---|---|
| 583,752 | 6/1897 | Johnston . | |
| 847,013 | 3/1907 | Kuhn . | |
| 1,205,884 | 11/1916 | Görlitz . | |
| 1,479,058 | 1/1924 | Daly . | |
| 1,506,154 | 8/1924 | Berthelsen et al. . | |
| 1,860,071 | 5/1932 | Bodkin . | |
| 2,587,177 | 2/1952 | Larson . | |
| 2,587,520 | 2/1952 | Peplow | 408/236 |
| 2,768,663 | 10/1956 | Jones . | |
| 2,909,083 | 10/1959 | Chestnut | 408/236 |
| 3,071,889 | 1/1963 | Silver . | |
| 3,184,190 | 5/1965 | Halfinger . | |
| 3,282,309 | 11/1966 | Parker et al. . | |
| 3,800,838 | 4/1974 | Morse . | |
| 3,828,834 | 8/1974 | Morse . | |
| 3,923,086 | 12/1975 | Spohn, Jr. | 408/237 |
| 4,061,165 | 12/1977 | Harwood et al. . | |
| 4,173,849 | 11/1979 | Mar . | |
| 4,265,283 | 5/1981 | Nash et al. . | |
| 4,265,284 | 5/1981 | Taylor . | |
| 4,318,432 | 3/1982 | Howey | 408/236 |
| 4,405,003 | 9/1983 | Watson et al. . | |
| 4,509,731 | 4/1985 | Schaal et al. | 269/901 |
| 4,555,099 | 11/1985 | Hilton | 269/901 |
| 4,909,491 | 3/1990 | Cheng . | |
| 5,018,563 | 5/1991 | Yoder . | |
| 5,082,037 | 1/1992 | Hammons et al. | 144/286.1 |
| 5,284,331 | 2/1994 | Lee et al. | 269/16 |
| 5,318,284 | 6/1994 | Demmeler et al. | 269/900 |
| 5,379,816 | 1/1995 | Charlton . | |
| 5,383,977 | 1/1995 | Pearce . | |
| 5,431,206 | 7/1995 | McAllister . | |
| 5,515,894 | 5/1996 | Dunn . | |
| 5,526,856 | 6/1996 | Pedri . | |
| 5,562,135 | 10/1996 | Beth et al. . | |
| 5,709,256 | 1/1998 | Thormeier . | |
| 5,782,279 | 7/1998 | Stecker, Sr. . | |
| 5,785,304 | 7/1998 | Little | 269/16 |
| 5,862,842 | 1/1999 | You | 144/286.1 |

*Primary Examiner*—W. Donald Bray
*Attorney, Agent, or Firm*—Michael I Kroll

[57] ABSTRACT

A workbench is provided that can be used as a conventional table (for the dining room, for card games, etc,.) and also provides the features of a carpentry and mechanics workbench. The workbench can be used in conjunction with an electric drill to provide the services of a sander, router, bench drill wood lathe, and bench saw.

7 Claims, 19 Drawing Sheets

WORKBENCH

The present invention relates to a table top configured to provide the features of an ordinary table as well as those of a carpentry and mechanics workbench. This table top is particularly suited for use where it is desirable to maximize the use of limited available space, e.g., a home workshop. Furthermore, when placed on a suitable support, the table top can be used as a conventional table that is very comfortable when a user is sitting at it because it has nothing under it to interfere with the user's legs.

BACKGROUND OF THE INVENTION

Tables or workbenches for carpenters and mechanics have been known for many years. Due to their size and design they occupy considerable space and are used only in appropriate place, such as workshops. These tables or workbenches are generally heavy and have both a vertical and a horizontal vise that tightens and holds objects against a stop.

There are also some small foldable benches, such as the Black and Decker Workmate 400 model. These workbenches offer the advantage of being compact and, when they are not in use, can be stored. These smaller benches, however, are just simple vises for holding objects and do not, and can not, provide the features of a full service workbench or those of a conventional table. The upper part of these small benches has two boards or sections. One of these boards can hold objects against the other and is tightened by means of two screw cranks, one at each end of the table.

Although many people would like to perform small do-it-yourself projects at home, including carpentry, mechanics, plumbing, etc., this has become practically impossible. Over the last thirty (30) years or so, migration to the cities has increased a great deal. At the same time, in the cities, the proportion of houses has decreased while the number of small apartments with limited space has increased. Whereas a house may contain sufficient space to comfortably accommodate a full size workbench and associated tools, allowing people to make their own furniture, an apartment normally will not contain space for such an item. Further, many homeowners are unwilling to allocate space to a full size workbench. People are now required, therefore, to seek specialists to meet even the smallest of these needs.

In spite of the need that do-it-yourself woodworkers have for a workbench, the solutions currently available in the market do not satisfy these needs. Vice benches like those referred to above, for example, although they are quite small, have no other practical application and thus need to be put away and hidden somewhere in the house when not in use. They must then be found and taken out, assembled for use, and then folded up and put away when no longer in use. This is generally found to discourage use of these vice benches. The invention described herein provides a solution for do-it-yourself woodworkers who wish to perform this type of work at home, comfortably, by themselves.

The present invention can be used as a conventional table (for the dining room, for card games, etc,.) and can also provide the functionality of a complete workbench, such as for clamping objects in a vase. The invention can also be used to provide the services of a sander, router, bench drill wood lathe, and bench saw, using only an electric hand drill held in place by a support on the board.

SUMMARY OF THE INVENTION

This invention is a table top configured such that, when used with an appropriate support, it provides the conventional functions of a dining room, card or game table and can also be used as a tool and workbench for do-it-yourself work. The board contains a series of holes distributed throughout its top surface, as well as in the skirt-like edges perpendicular to the board top surface around its perimeter. A slot is provided in the top surface for a square to guide a piece of wood being worked on and another narrower slot, running parallel to the first one, is provided in the top surface of the table top to receive a removable circular saw. There are one or more supports located under the board, four bases for table legs and/or a central pivot support if desired. The tools to be used with the table top, when it is used as a workbench or as a table for do-it-yourself-work, are held on tool holders located under the board. This keeps the tools handy so that the table can provide the services of a polisher, wood lathe, fixed drill press, router, and bench or table saw. This arrangement of tools and holders under the board has been designed in such a way that when a person is seated at the table, in order to play cards, for example, he will be comfortable, without there being any objects that he could bump into or that could injure his knees or legs.

DETAILED DESCRIPTION OF PREFERRED EMBODIMENTS

Figure 1:
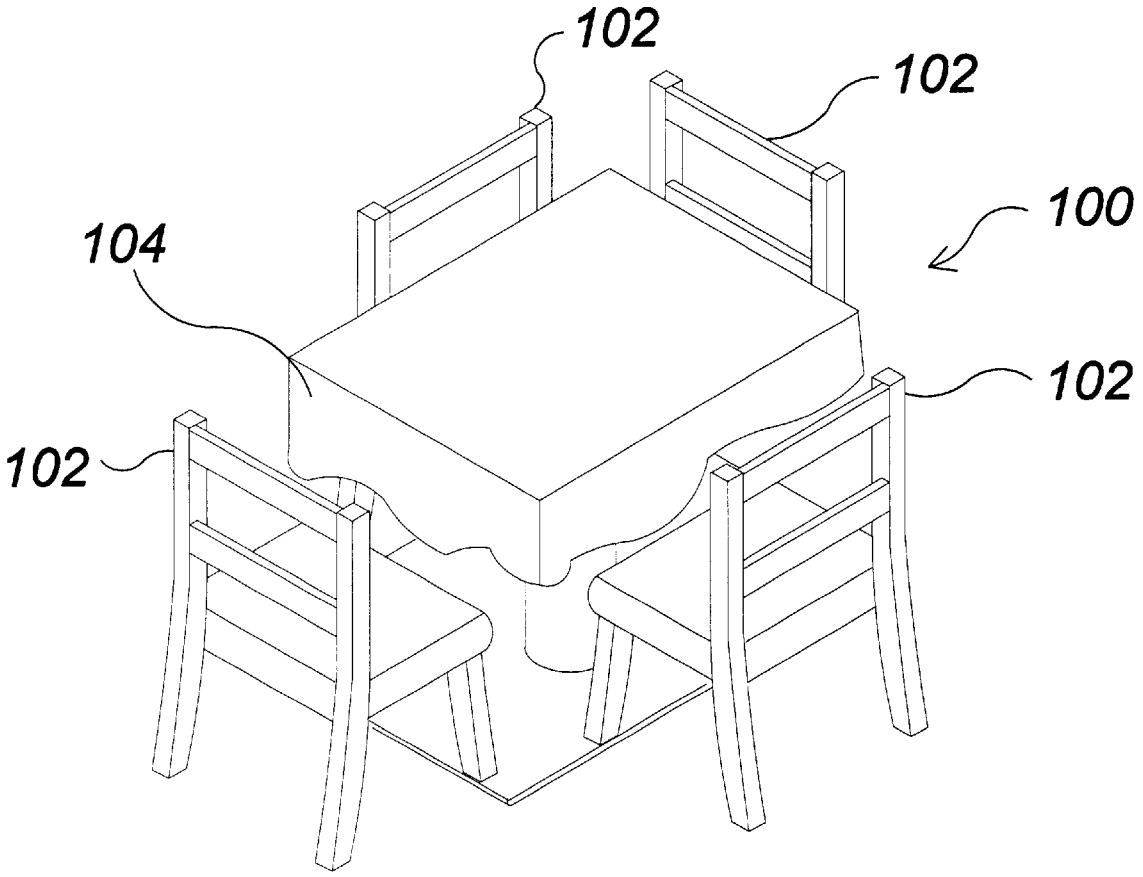
FIG. 1 is an elevation view of the table top of a preferred embodiment of the present invention depicted as it would be used as a conventional table.

Referring now the figures wherein like reference numerals indicate like elements, in FIG. 1 the invention is shown as it would be used as a conventional table. Without needing to be moved, the table 100 can be used in the same place for do-it-yourself-work. When the four seats 102 are taken away and the tablecloth or cover 104 on the table 100 is removed, the table top 106 (FIG. 2) is revealed.

The table top 106 top surface 108 has a number of symmetrically distributed holes 110. Each hold is separated from adjacent holes by a distance which is less then the distance traveled by the screw 112 of the jaw 114 of the vise 116 used to tighten and hold a work piece 118. The distance separating the holes are also less than the length of the jaws of other types of clamps such as that of the hold fast or dog clamp 120.

Figure 3:
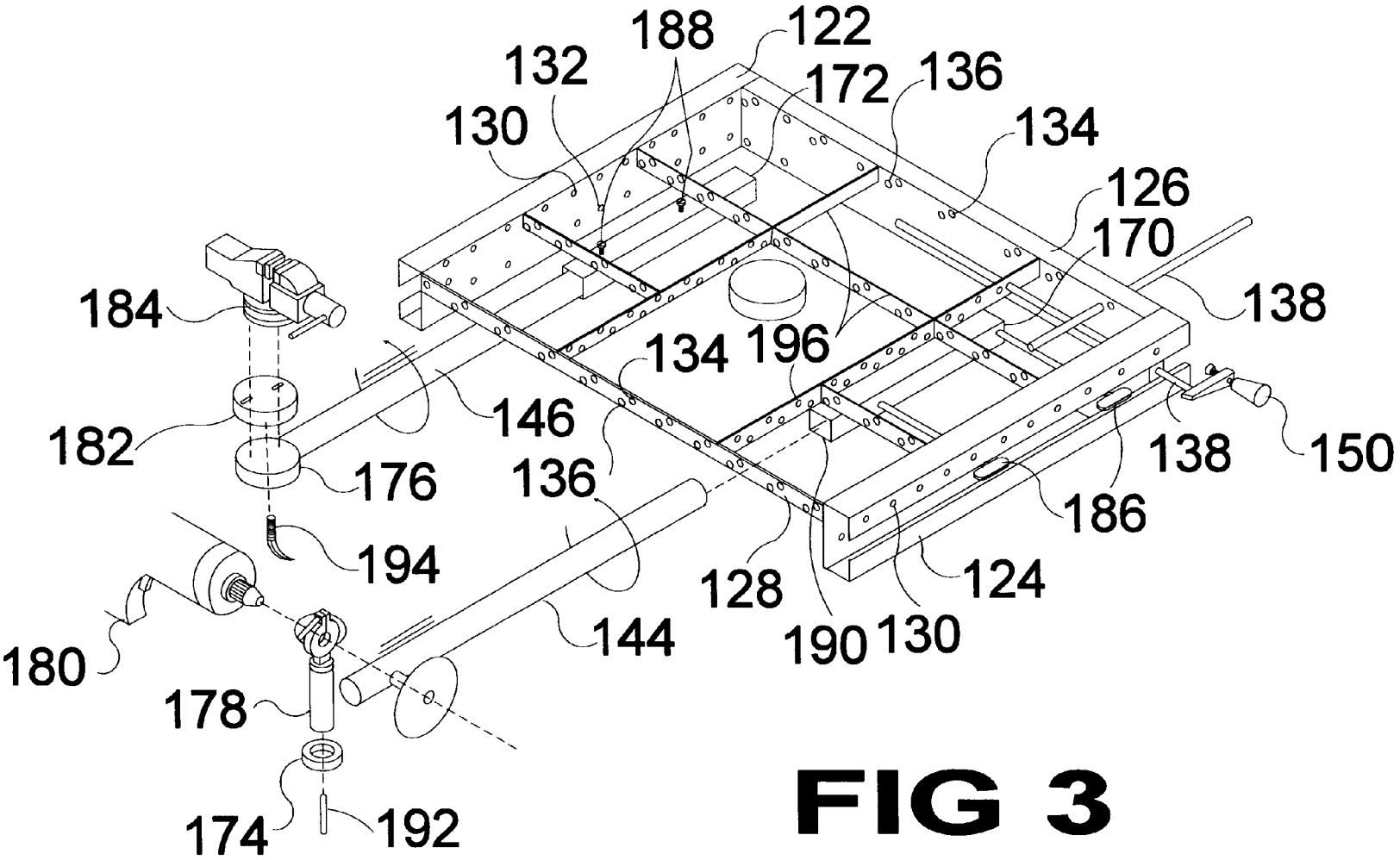
FIG. 3 is an exploded view of the structural framework of a first preferred embodiment of the table top of FIG. 1 showing the placement of the tool holders and support bars. Arrows are included on the figure to show the ways in which the tools can be aligned.

Three of the skirt-like edges 122, 124, 126 have a hollow rectangular cross section with a channel running down the middle of its external edge parallel to the plane of the top surface. The skirt-like edges 122, 124, 126, 128 have holes in different levels. In particular, two of the parallel skirt-like edges 122, 124 have two parallel horizontal rows of matching holes 130, 132. (FIG. 3). The skirt-like edges 126, 128 also have two parallel horizontal rows of matching holes 134, 136.

Figure 2:
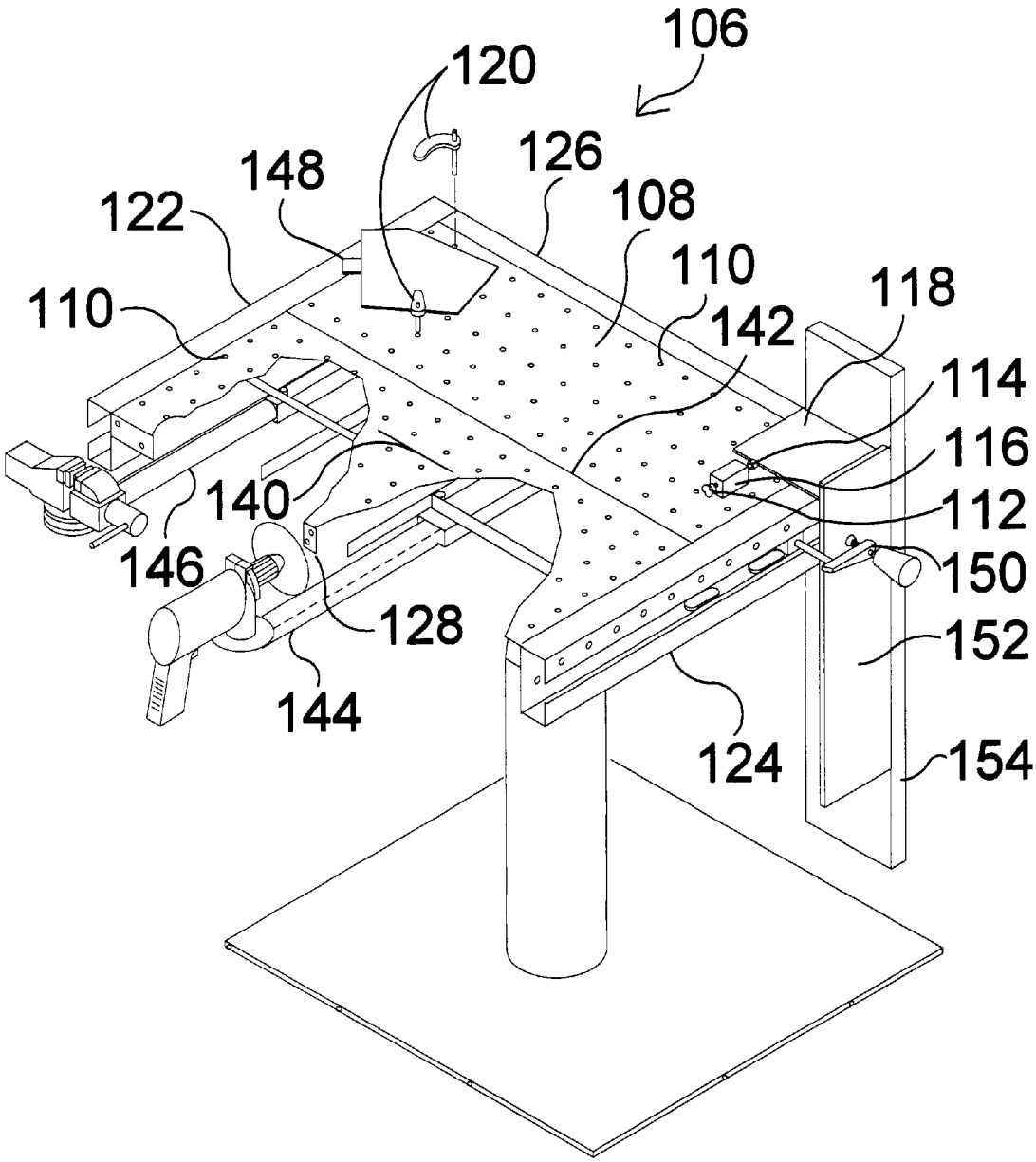
FIG. 2 is an elevation view, with cutaway portions, showing use of the table top of FIG. 1 as a worktable. Also depicted in FIG. 2 are some of the accessories and attachments used in conjunction with the table top. There are hold fast or dog clamps and other types of jaws, which can be anchored in the holes in the surface and the skirts or edges of the board.

The holes 130, 132, 134, 136 in each level are equally separated from the adjacent holes in that level by the same distance separating the holes in the surface 108 (FIG. 2). The arrangement of the holes permits rods 138 (FIG. 3) to be passed below the surface 108 of the table top 106 simultaneously, in perpendicular directions, without interfering with each other. These rods 138 can also be held in place firmly by screws.

The surface 108 has a first slot 140 (FIG. 2) for permitting a disk or cutting wheel of a circular saw to pass through the table top 106 and another slot 142, parallel to the first slot 140, for receiving a square to be used as a guide.

Except for one edge 128 where the bars 144, 146 of the tool supports are permitted to extend out from under the table top 106, the vertical width of the remaining edges 122, 124, 126 should be as wide as possible but not so wide as to prevent a person from sitting comfortably at the table with their legs under the table top 106. The surface 108 and the skirts or edges 122, 124, 126, 128 of the table top 106 should be sufficiently thick to permit hold fast or dog clamps 120 to be anchored in the holes of the table top 106.

The holes in the top surface 108 and skirts 122, 124, 126, 128 of the table top 106 make it possible for the table to be used as a vise with the aid of stops 148, tightening rods 150, vice 116 and the hold fast or dog clamps 120. These holes are dispersed symmetrically over the surface of the table top 106 to allow objects to be clamped on any side of the table in the various arrangements.

The object to be fastened or clamped can be placed on the surface 108 of any part of the table top 106 or on three of its skirt-like edges 122, 124, 126 since the hold fast or dog clamps 120, stops 148 and vice 116 can be inserted in any hole in the table top 106. Several objects can therefore be clamped or placed simultaneously, in any of the several holes of the table top 106 or on three of its skirt-like edges 122, 124, 126.

The holes in the skirt-like edges 122, 124, 126, 128 of the table top 106 allow it to be crossed from below its surface by means of rods 138 to allow large or voluminous objects to be clamped in a vertical direction. Several work pieces 118, 152, 154 may also be clamped, simultaneously, on the surface 108 and/or skirt-like edges 124, 126 of the table top 106 using different jaws.

Figure 4:
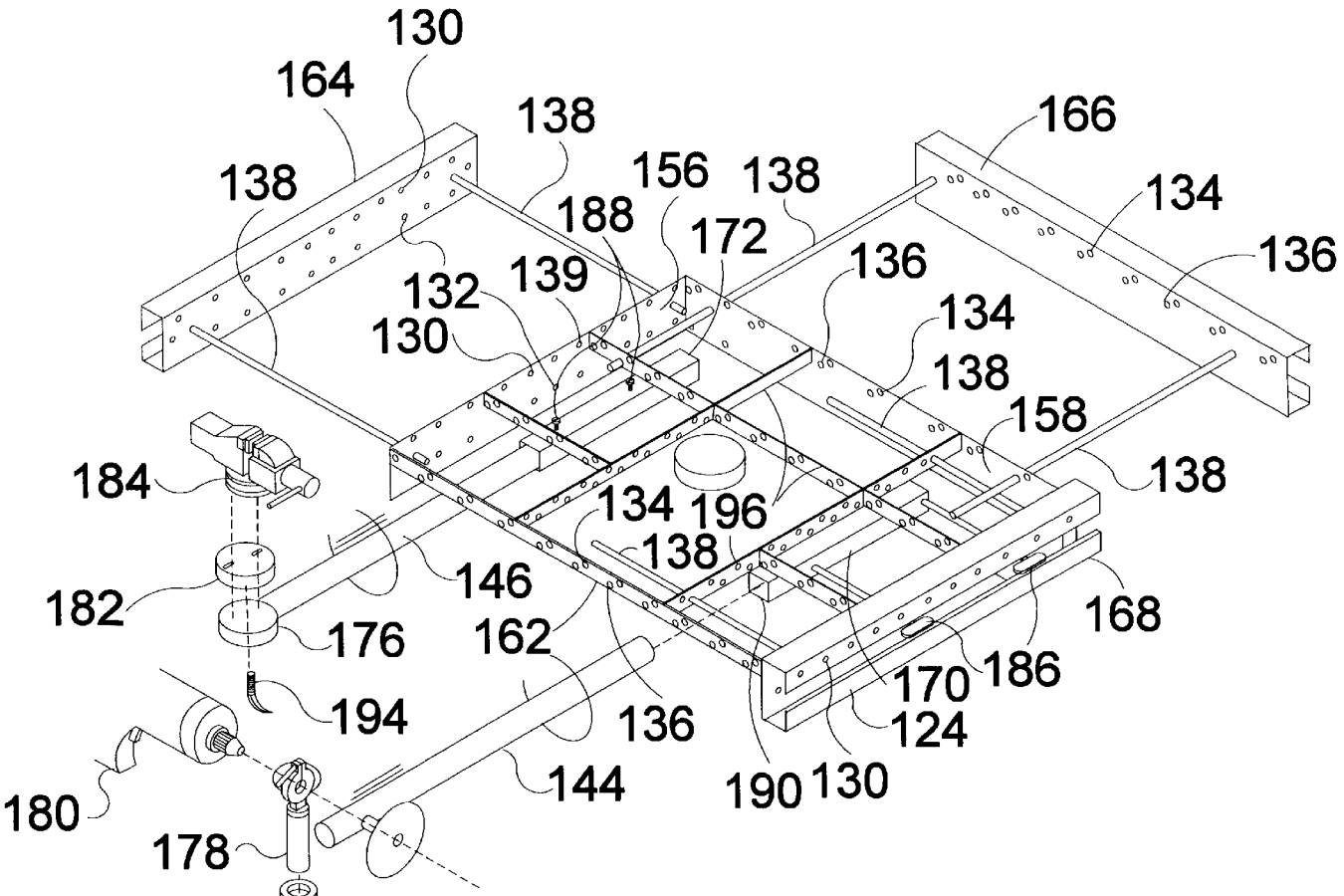
FIG. 4 is an exploded view of the structural framework of a second preferred embodiment of the table top of FIG. 1 depicted with two support surfaces extended out from the table top to serve as supports for larger work pieces or to hold guides used for cutting work piece with the table saw.
Figure 18:
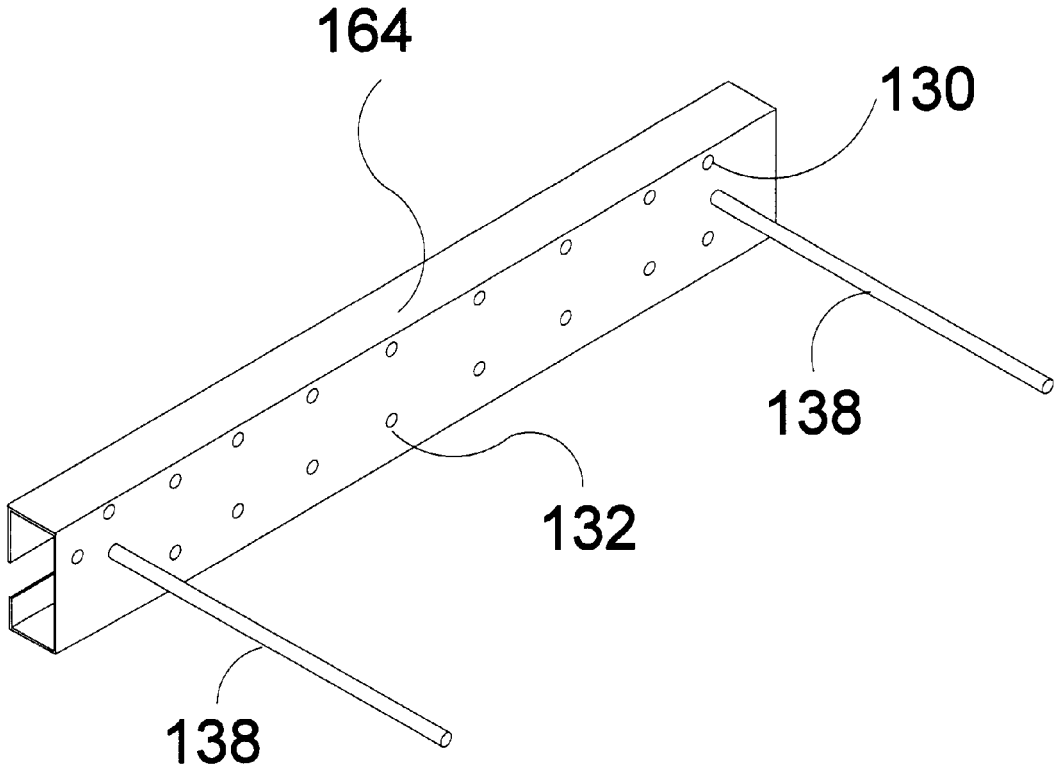
FIG. 18 is an elevation view of the telescoping support surfaces of the table top of FIG. 1.

In an alternate embodiment of the invention, depicted in FIG. 4, the skirt-like edges are flat supporting surfaces 156, 158, 160 (not shown), 162. Two of the parallel edges 156, 160 have two parallel horizontal rows of matching holes 130, 132. The other two parallel edges 158, 162 also have two parallel horizontal rows of matching holes 134, 136. Support surfaces 164, 166, 168 are supported by the skirt-like edges 156, 158, 160 by two rods 138. Each of the support surfaces has an end block with a hollow rectangular cross section and has a channel running down the middle of the outer edge parallel to the top surface. Each of the support surfaces 164, 166, 168 has two parallel lines of holes which match those of the skirt-like edges 156, 158, 160 supporting the support surfaces. These telescoping surfaces (also depicted in FIG. 18) can also serve as supports for a guide for making longitudinal cuts with the disk table saw when the piece of wood to be cut is very wide. The holes selected for receiving the rods 138 of each of the telescoping surfaces are selected so that the rods will not interfere with each other when inserted fully into the table.

As depicted in FIGS. 3 and 4, below the table top 106 there are two parallel conduits 170, 172 that are set further back from the narrow skirt-like edge 128, and perpendicular to that edge. Each of the bars 144, 146 supports a mounting surface 174, 176 at its terminal end. One of the bars 144 supports a mounting surface 174 for receiving the holder 178 of a drill 180 and the other bar 146 supports a mounting surface 176 for receiving a holder 182 of a mechanic's vise 184.

The conduits 170, 172 have a square cross section and are hollow. These conduits also have a depth that is less than the skirt-like edges of the table top 106, and do not impede rods 138 from being inserted into the skirt-like edges parallel to or perpendicular to the conduits. The first conduit 170 has a surface with holes for receiving screws 186 for fixing both the rotational alignment of the bar 144 and the length to which it is inserted in that conduit 170. The second conduit 172 also has a surface with performations for receiving screws 188 for fixing the bar 146 within the conduit 172.

Figure 20:
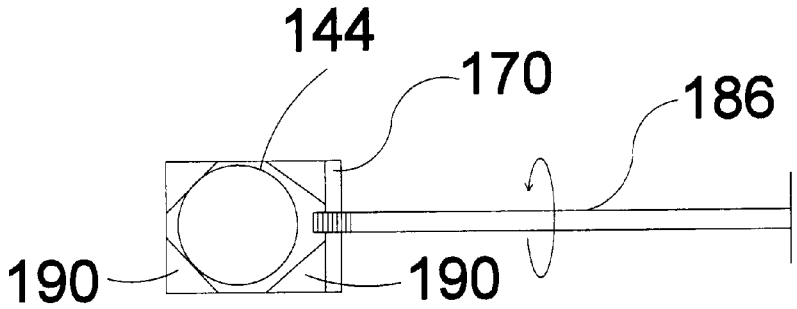
FIG. 20 is a layout view of a first preferred mechanism for fixing the position of the tool support bars of the table top of FIG. 1.

The bars 144, 146 are moveable within the conduits 170, 172. They can be slid outward from the conduits and can turn through 360° to place the tools that hold the supports at different heights above and below the level of the top surface 108. When the bars are below the top 108, they have limited rotational movement and can be positioned for using the tools or for hiding the tools. The bars 144, 146 are fixed in their position by screws 186, 188 that can be adjusted from holes in either the top surface 108 or skirt-like edges of the table top 106. The screws press the bars 144, 146 up against a wedge 190 on the inside of the conduits 170, 172 (FIG. 20). The bars can be fixed in place by other mechanisms to be described below.

Tool holders 178, 182 are connected perpendicularly to mounting surface 174, 176 which are connected to the terminal end of each bar 144, 146 and the bars are inserted into the conduits 170, 172 that are set further back from the narrower skirt-like edge 128. The tool holders 178, 182 can be rotated through 360° within the tool mounting surface 174, 176. Screws 192, 194 pass up through the mounting surfaces 174, 176 into the respective tool holders 178, 182 to fix the tool holders in the desired position in relation to the mounting surface.

The screw 192 for fixing the drill holder 178 to the mounting surface 174, is longer than the screw for fixing the vise holder 182 to the mounting surface 176. When the tool holder 178 supports the electrical hand drill 180, this drill together with holder 178, which can be used as an additional handle, can easily be separated from the rest of the support. Thus, the mounting surface 174 that receives the drill holder 178 has the central long screw 192. The long screw 192 can easily be screwed into the hollow threaded base of the drill holder 178. Thus the drill holder 178 can be quickly placed, fixed or separated from the rest of the support, by turning screw 192. Similarly, a screw 194 is fed up through the vise mounting surface 176 into the vise holder 182 to secure it in place and fix its rotational direction.

Cross braces 196 are used to reinforce the table top 106 when it is manufactured from a thin material and to keep the rods 138 aligned properly. Holes are distributed in the cross braces and are matched to and aligned with the holes of the parallel skirt edges.

Figure 5:
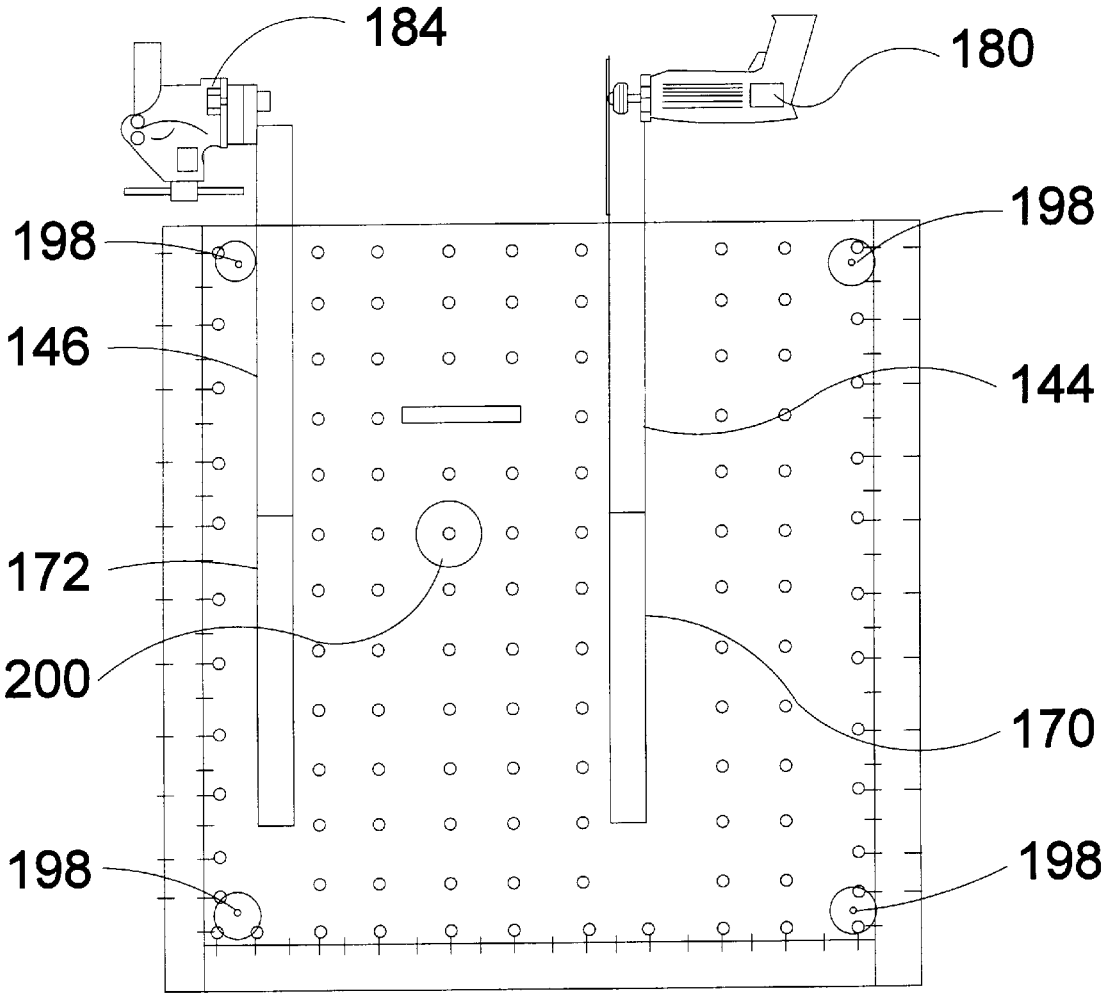
FIG. 5 is bottom plan view of the table top of FIG. 1 wherein the supports for the tools, which are extended so that they appear outside the surface area of the table top, are depicted. For better comprehension of the invention, some of the additional items are not depicted.
Figure 6:
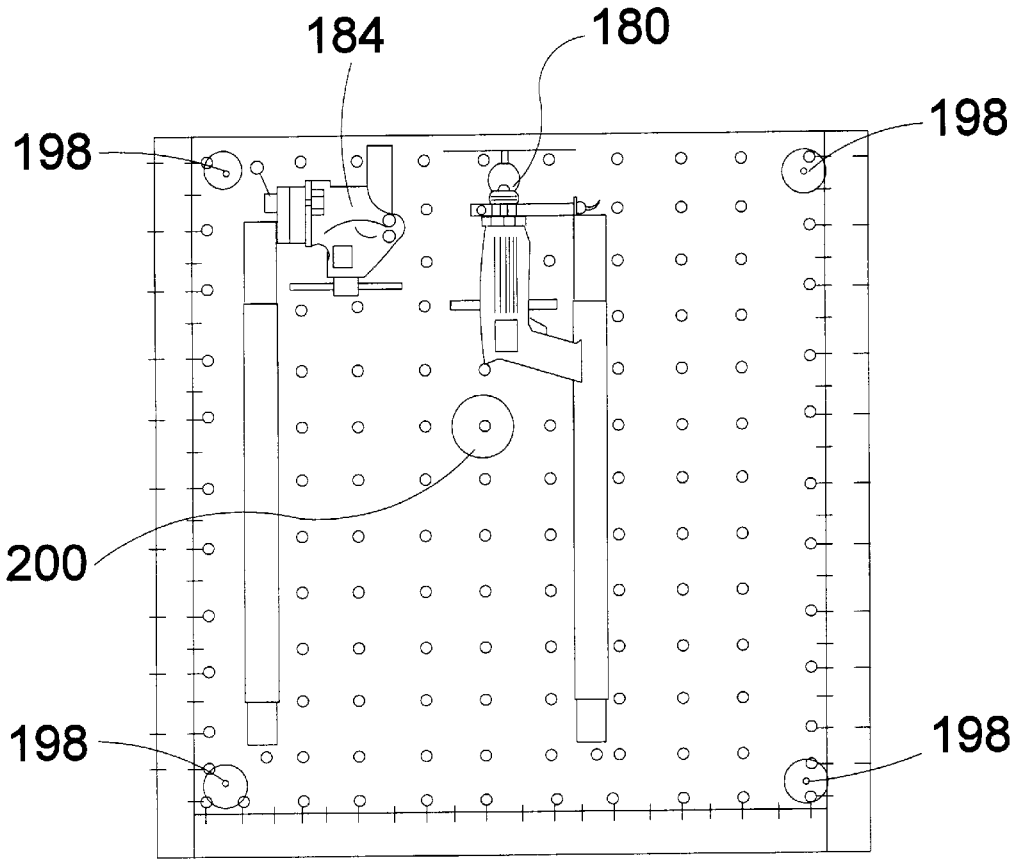
FIG. 6 is a bottom plan view as in FIG. 5 wherein the tools are shown stored under the table top.

Referring now to FIGS. 5 and 6, it is seen that underneath the table top are bases 198 for connecting legs to the table top 106. Alternatively, there is also a center base 200 which can rotate so that the table top 106 can be pivoted through 360° if the board is installed on just one center leg or post.

FIG. 5 depicts the table top 106 with the bars 144, 146 extended outward from the conduits 170, 172 so that the drill 180 and vise 184 can be used. FIG. 6 depicts the table top 106 with the drill 180 and the vise 184 stored underneath the table.

As a result of the design of the present invention, the tools may be configured in various ways because: (1) the tool holders 178, 182 can be turned 360° on the mounting surface 174, 176 mounted at the ends of the bars 144, 146; (2) the bars 144, 146 can be turned 360° within the conduits 170, 172; (3) the tools can be extended outward from the table or placed under the table by sliding the bars 144, 146 within the conduits; and (4) the drill can be rotated within the tool holder 178.

Figure 7:
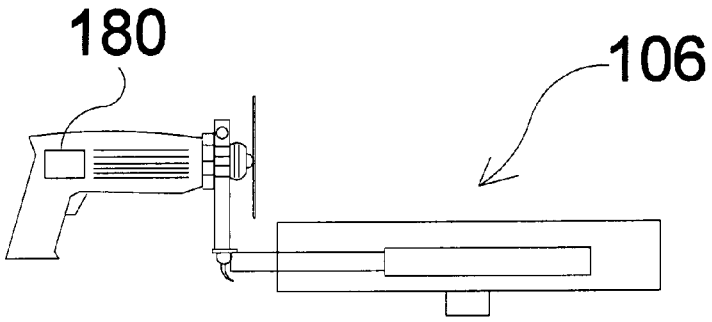
FIG. 7 is a side plan view of the table top of FIG. 1, wherein the drill holder is aligned to permit use of the table top as a bench polisher and sharpener.
Figure 8:
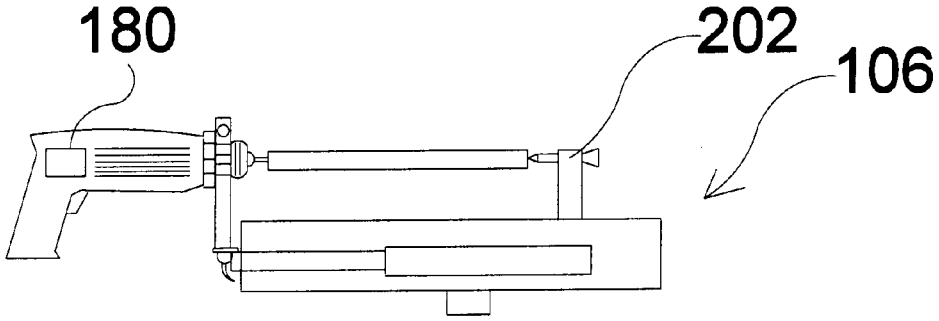
FIG. 8 is a side plan view of the table top of FIG. 1 wherein the drill holder is aligned to permit use of the table top as a wood lathe.
Figure 9:
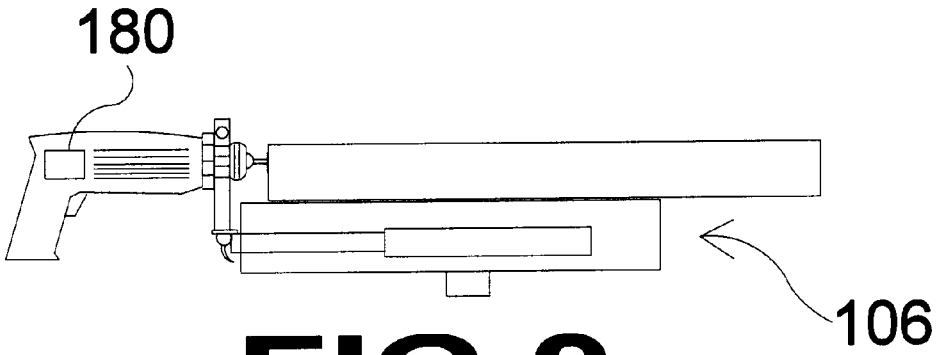
FIG. 9 is a side plan view of the table top of FIG. 1 wherein the drill holder is aligned to permit use of the table top as a bench drill.
Figure 10:
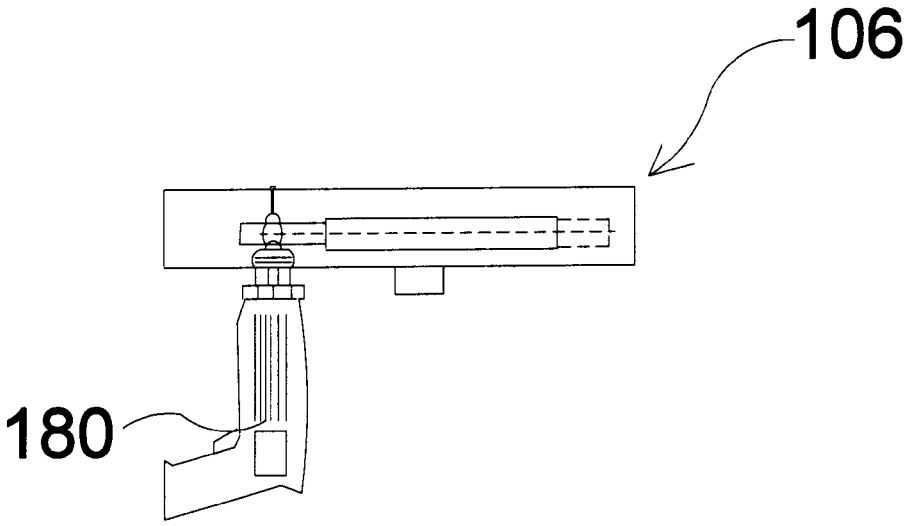
FIG. 10 is a side plan view of the table top of FIG. 1 wherein the drill holder is aligned to permit use of the table top as a fixed router.
Figure 11:
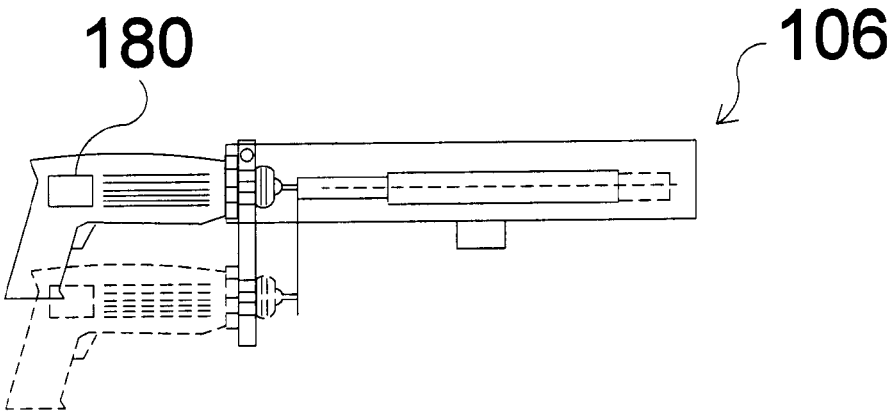
FIG. 11 is a side plan view of the table top of FIG. 1 wherein the drill holder is aligned to permit use of the table top as a bench or table saw.

The combination of movements allows the vice 184 to be placed in a desirable position and allows the electric hand drill 180 to be placed in such a way as to allow the table to be used as a sander or polisher, to be placed in the desired angle for sharpening tools (FIG. 7), to place it against a work piece pressed up against a point 202 placed in the board surface, so that the workbench 106 can be used as a wood lathe (FIG. 8), also it can be used as a fixed bench drill that can be graduated in height (FIG. 9), also if placed vertically under the table the drill 178 can be used as a route (FIG. 10), and if aligned horizontally under the board, the table 106 can be used as a bench or table saw that can be adjusted in height (FIG. 11). The tools that are held by the supports can be hidden under the board surface when it is used as a conventional table FIG. 1, 5, and 6.

Figure 12:
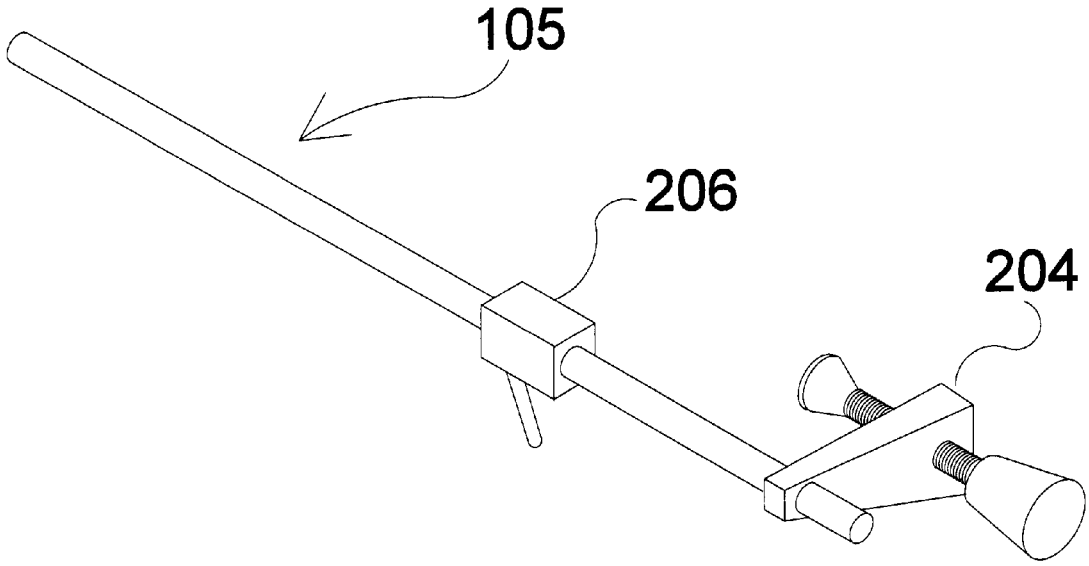
FIG. 12 is an elevation view of a tightening rod with a clamp and tie bar.

The accessories that can be used with the foregoing table top 106 include the tightening rods depicted in FIG. 12. These are a little shorter than one side of the table top 106 and at one end they have a vise 204 that can clamp up against the edge of the board and hold relatively large work pieces. It also is useful for extending the support points of the board and as a guide for the disk or table saw. The tightening rods have a stop 206 that can be secured in one of the holes on the table top 106 top surface 108 or skirt like edges 122, 124, 126, 128.

Figure 13A:
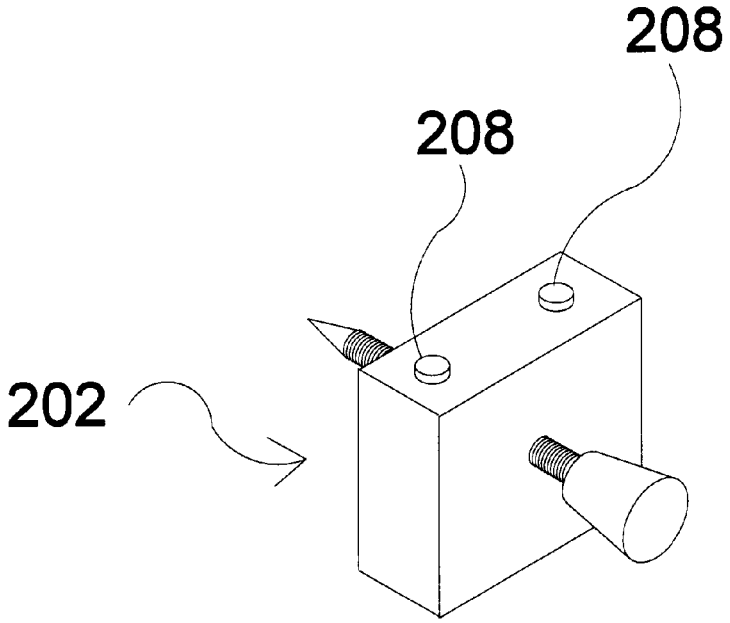
FIG. 13*a* is an elevation view of a support point employed when using the table top of FIG. 1 as a wood lathe.
Figure 13B:
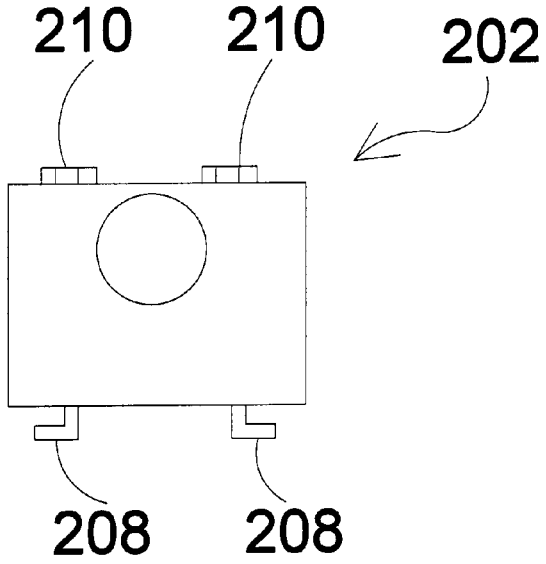
FIG. 13*b* is a plan view of the support point of FIG. 13*a*.

Another accessory for use with the table top 106 is the point 202 depicted in FIGS. 13*a* and 13*b*. The point includes clips 208 which when placed into the holes in the table top 106 facilitate securing the point into place by turning the hex heads 210.

Figure 14:
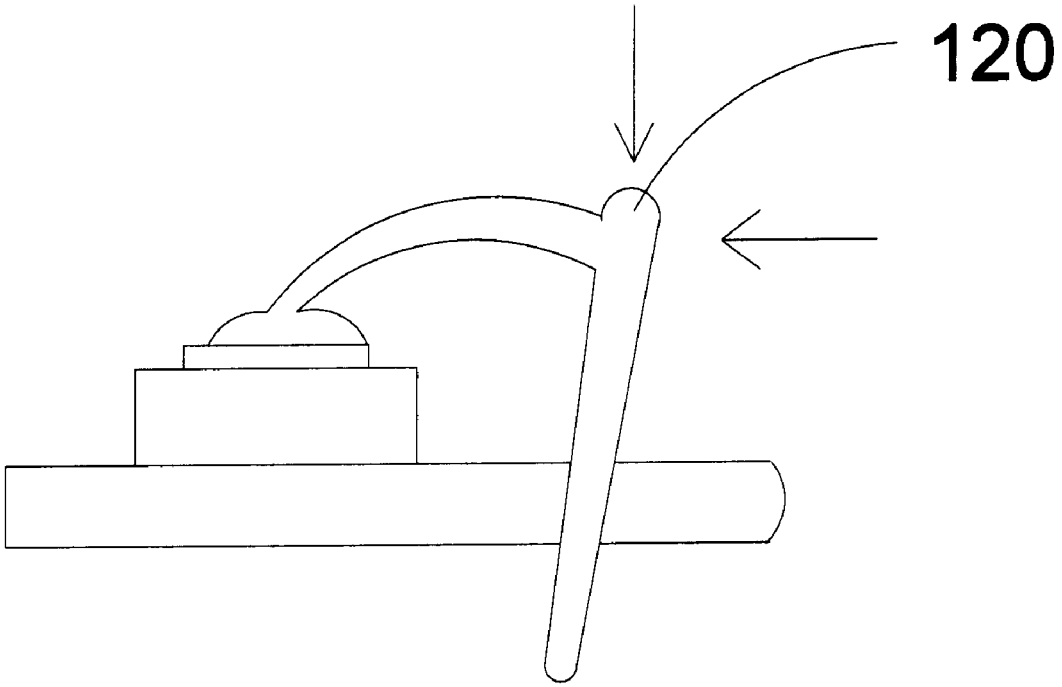
FIG. 14 is a plain view of a small hold fast or dog clamp for holding thin objects.

A hold fast, or dog clamp 120 is depicted in FIG. 14. This is a walking cane shaped gripping jaw, that can be used as a clamp or to hold pieces. It only needs to have its post placed in one of the holes of the table top 106, the work piece placed under its gripping arm and then it can be tightened against the bench by striking the head of the dog barrel. Striking the side of the head loosens the clamp.

Figure 15A:
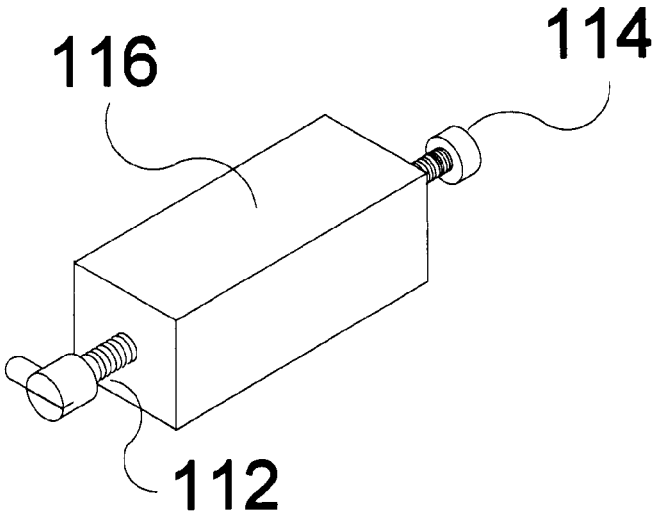
FIG. 15*a* is an elevation view of a screw clamp for fastening and holding objects on the surface and the skirts or edges of the table top of FIG. 1.
Figure 15B:
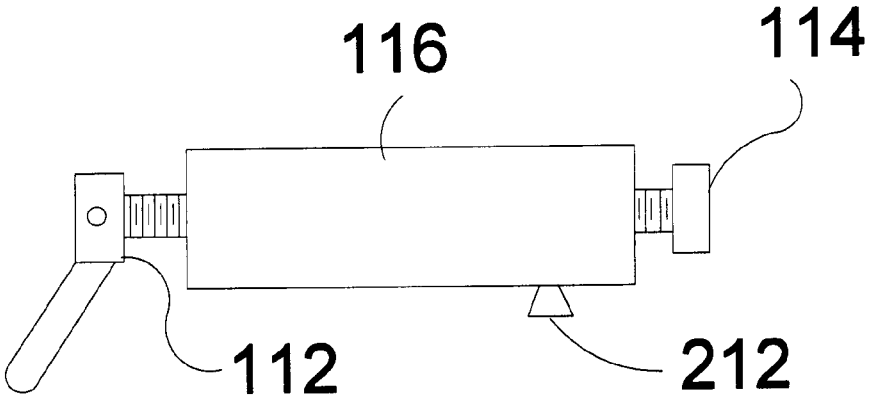
FIG. 15*b* is a plan view of the screw clamp of FIG. 15*a*.
Figure 16A:
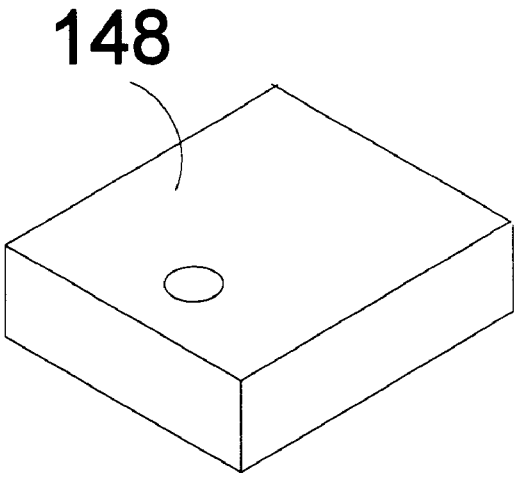
FIG. 16*a* is an elevation view of a stop that can be engaged on the surface and skirt or edges of the table top of FIG. 1.
Figure 16B:
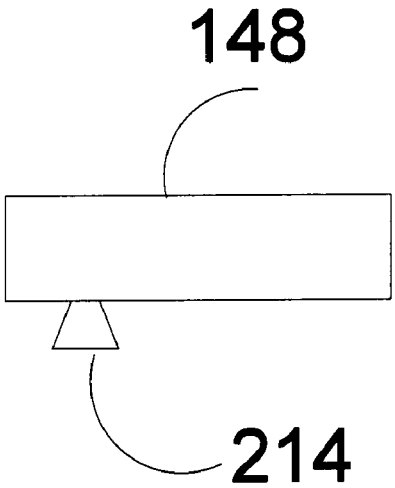
FIG. 16*b* is a plan view of the stop of FIG. 16*a*.

Depicted in FIGS. 15*a* and 15*b* is a vice 116. This is an element just like the stop but that has a screw 112 perpendicular to the pivot so that, as it is turned it can clamp an object against a stop 148 (FIGS. 16*a* and 16*b*). At the bottom of the screw clamp 116, there is a post 212 which when placed in a hole in the table top 106, and when pressure is applied by forcing the jaw against a fixed object, secures the vice from moving.

The stops 148 of FIGS. 16*a* and 16*b* are small blocks that have, at their base, a post 214 to be placed in the holes of the table top 106 to keep them from sliding when they receive pressure from the screw of the clamp that presses an object against them.

Figure 17A:
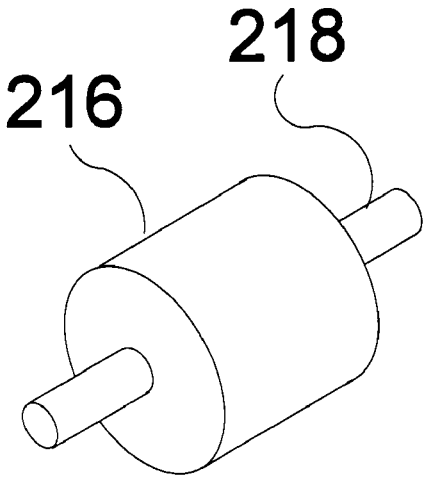
FIG. 17*a* is an elevation view of a free wheel cylinder for a drill with no collar.
Figure 17B:
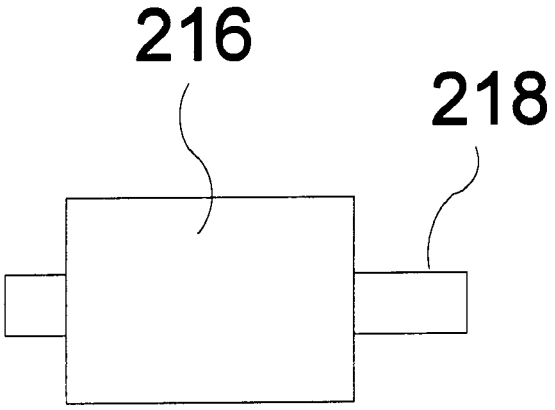
FIG. 17*b* is a plan view of the free wheel cylinder of FIG. 17*a*.
Figure 19:
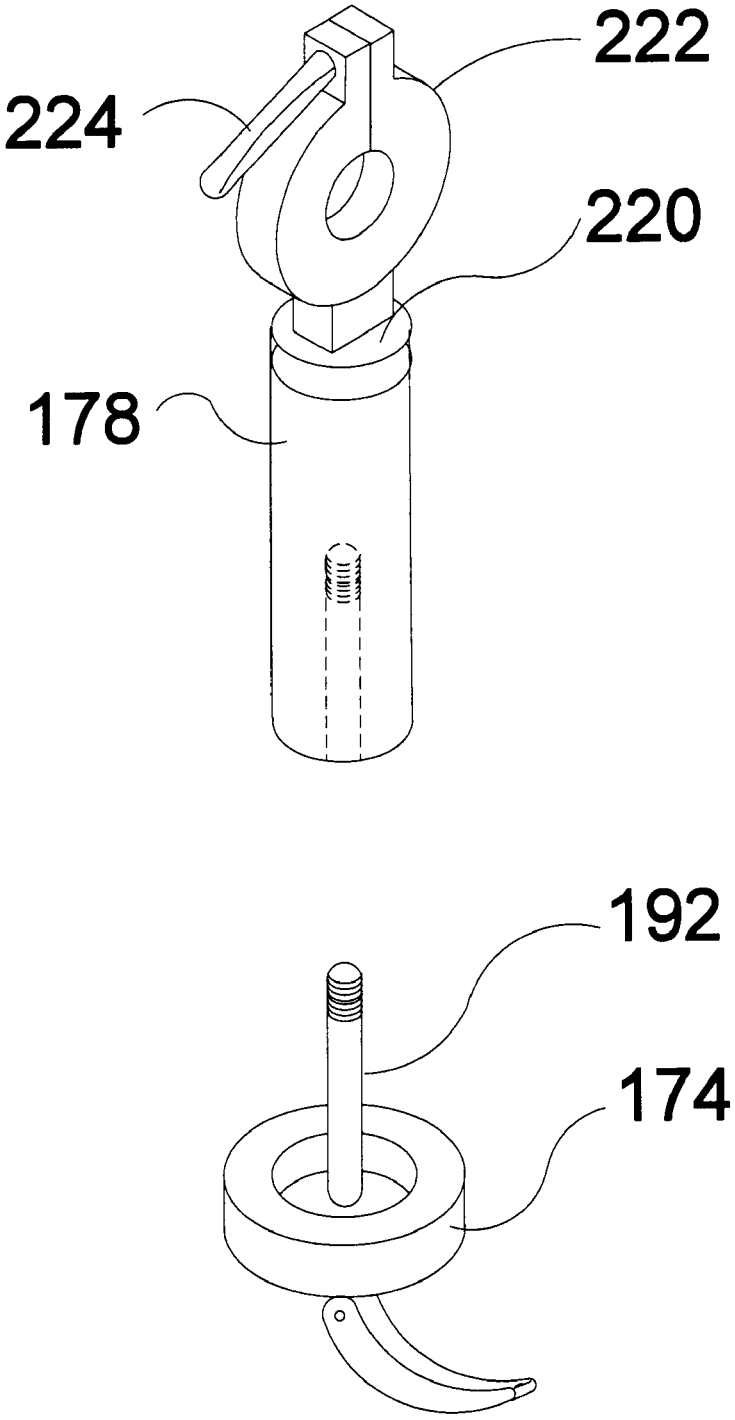
FIG. 19 is an elevation view of a drill holder with the drill holder mounting surface and securing screw.

In FIGS. 17*a* and 17*b* there is depicted a bushing 216 which is a cylinder having a diameter selected so that it can be held by the drill holder 178 (FIG. 19). It has a free wheeling shaft 218 which, at one end, can hold drill bits, disks etc. and can be tightened by a conventional chuck key. The bushing 216 is secured into an electric drill to make the shaft 218 of the bushing turn. This bushing is used when the electric hand drill 180 to be used with the table top 106 does not have a collar for the drill holder 178 to clamp on to.

As depicted in FIG. 19, the drill holder 178 contains a hollow grip with a threaded receiving surface 220 at its end on which a clamp head 222 is fixed. The clamp head 222 has a circular opening which can be tightened around the bushing 216 (FIG. 17*a* and 17*b*) or the collar of a drill 180 using a screw 224.

It is desirable that the tool support bars 144, 146 be fixable in relation to the table top 106 both rotationally and with respect to the distance to which they extend outward of the conduits 170, 172. Several mechanisms have been devised for fixing the position of the tool support bars 144, 146 and are depicted in FIGS. 20–24. While these mechanisms are described in relation to one of the support bars, it should be readily understood that each support bar can be configured with any one of the mechanisms.

In particular, in FIG. 20 there is shown one of the screws 186 used to secure the position of the support bar 144. As will be readily understood, as the screw 186 is turned to project further into the conduit 170, the screw will press the support bar 144 against the wedge of the opposite wall 190 fixing the position of the support bar 144 both rotationally and with respect to its position within the conduit 170.

Figure 21A:
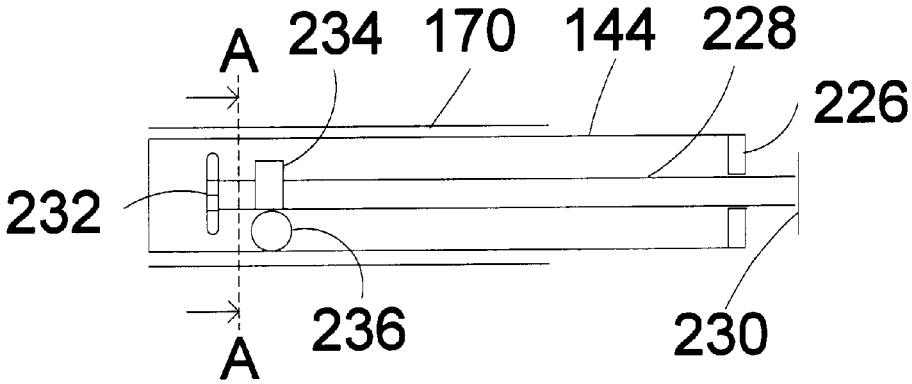
FIG. 21*a* is a layout view of a second preferred mechanism for fixing the position of the tool support bars of the table top of FIG. 1, depicted in the disengaged state.

In FIGS. 21*a* and 21*b* and FIGS. 22*a* and 22*b*, there is depicted a second preferred mechanism for fixing the position of the support bars 144, 146. As depicted in FIG. 21*a*, the support bar 144 is a hollow bar within the conduit 170. Running down the center of the length of the support bar 144, and passing through an opening 226 at the distal end of the support bar 144, is a securing rod 228. At one end of the securing rod 228 there is a knob 230 which can be rotated by a user. At the other end of the securing rod 228 there is a spacer 232 for keeping the securing rod centered within the support bar 144.

A cam 234 is fixed to the securing rod 228 near the end closest to the spacer 232. One or more ball bearings 236 are provided within holes 238 provided in the support bar 144. The ball bearings 236 are placed so as to be in contact with the surface of the cam 234.

Figure 21B:
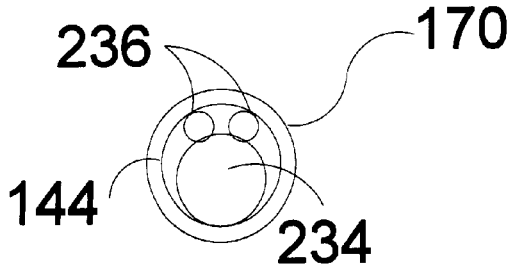
FIG. 21*b* is a sectional view taken along lines A—A of FIG. 21*a*.
Figure 22A:
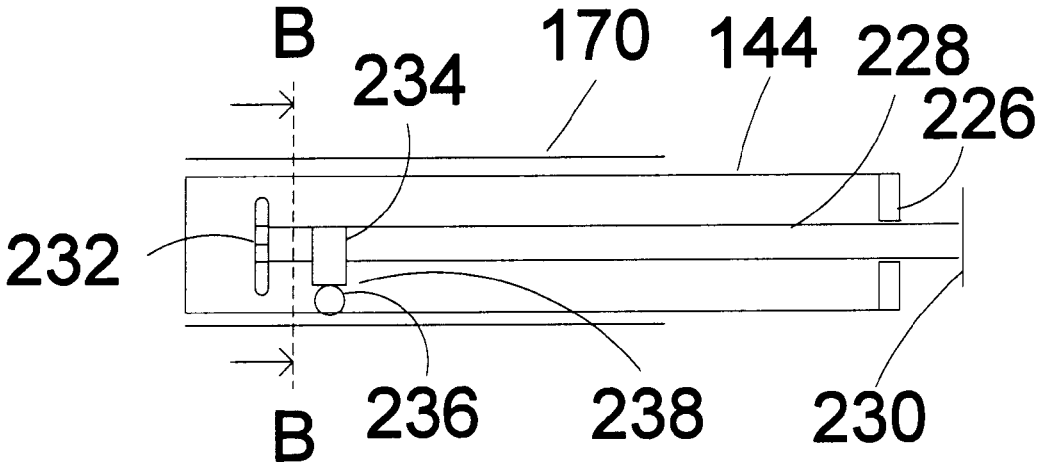
FIG. 22*a* is a layout view of the second preferred mechanism for fixing the position of the tool support bars of the table top of FIG. 1, depicted in the engaged state.
Figure 22B:
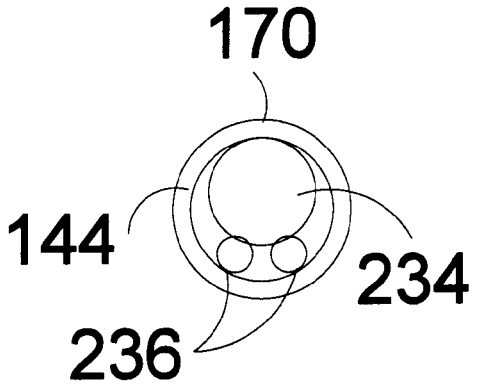
FIG. 22*b* is a sectional view taken along the lines B—B of FIG. 22*a*.

When it is desired to move the support bar 144 in relation to the conduit 170, the knob 230 is turned so that the ball bearings 236 have minimal or no contact with the conduit 170. This is depicted in FIG. 21*b* wherein it is shown that the ball bearings 236 are not contacting the conduit 170 surface.

When it is desired to fix the position of the support bar 144 in relation to the conduit 170, the knob 230 is turned so that the cam 234 forces the ball bearings 236 in contact with the conduit 170 surface. The present mechanism for fixing the position of the support bar 144 will be readily understood with reference to FIGS. 22*a* and 22*b*.

Figure 23A:
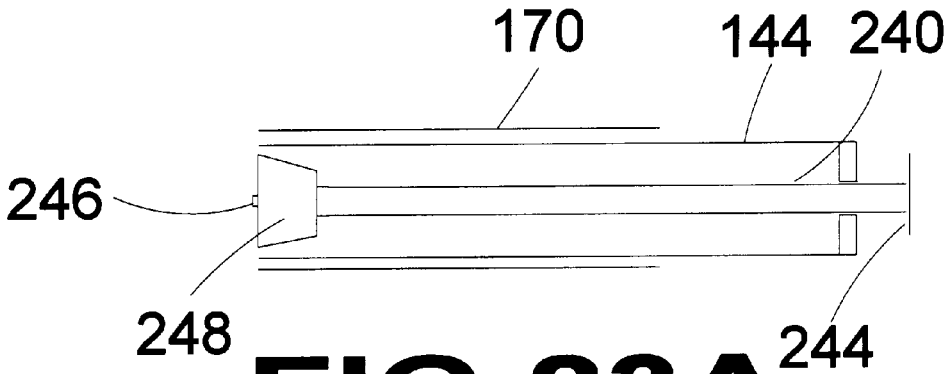
FIG. 23*a* is a layout view of a third preferred mechanism for fixing the position of the tool support bars of the table top of FIG. 1, depicted in the disengaged state.
Figure 23B:
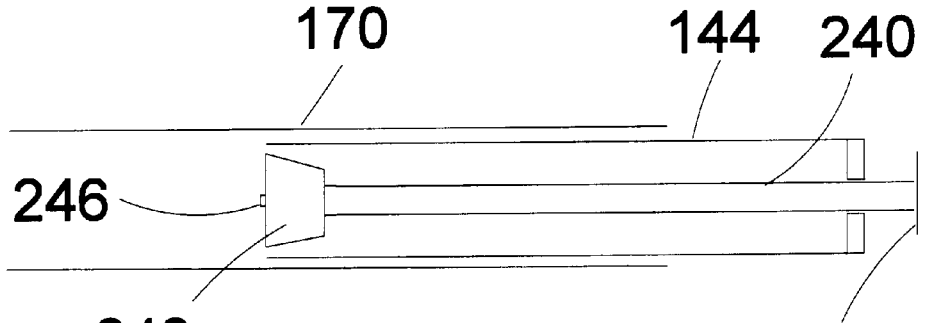
FIG. 23*b* is a layout view of the mechanism of FIG. 23*a*, depicted in the engaged state.

A further mechanism for fixing the position of the support bar 144 within the conduit 170 is depicted in FIGS. 23*a* and 23*b*. In accordance with this mechanism, the support bar 144 is a hollow rod made from a semi-rigid material. A securing rod 240 is arranged within the support bar so that it extends outward of the support bar at one end and terminates in a securing knob 244 so that the securing rod can be pushed inward or pulled outward in relation to the support bar. The opposite end of the securing rod 246 extends outward of the other end of the support bar 144 and terminates in a conical piston 248.

As shown in FIG. 23*a*, when it is desired to realign the support bar 144, the securing knob 244 is pushed inward toward the support bar 144. The support bar is then free to move. When it is then desired to fix the position of the support bar 144, the securing knob 244 is pulled outward forcing the conical piston 248 into the end of the hollow support bar 144. The end of the support bar 144 is thereby expanded causing it to come into contact with the inside of the conduit 170 thereby fixing the support bar in place.

Figure 24:
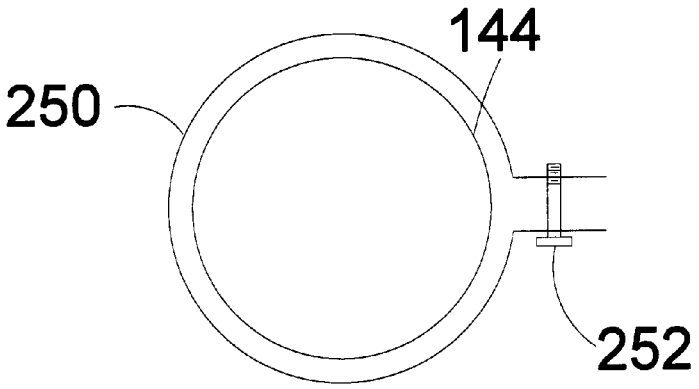
FIG. 24 is an end plan view of a fourth mechanism for fixing the position of the tool support bars of the table top of FIG. 1.

A further mechanism for fixing the support bar 144 in place is depicted in FIG. 24 which shows the support bar passing through a ring clamp 250. In accordance with this mechanism for securing the position of the support bar 144, the ring clamp is affixed to the conduit 170 or the table top 106. Then, by tightening the screw 252 of the ring clamp, the support bar is fixed in place.

The above description and drawings are only illustrative of preferred embodiments which achieve the objects, features and advantages of the present invention, and it is not intended that the present invention be limited thereto. Any modification of the present invention which comes within the spirit and scope of the following claims is considered part of the present invention.

What is claimed as new and desired to be protected by Letters Patent of the United States is:

1. A workbench adaptable for use as a general purpose table comprising:

a) a flat, rectangular table top substantially smooth on an upper surface thereof having a plurality of spaced holes and one or more slots to accommodate a cutting wheel of a circular saw and for receiving a square to be used as a guide, said upper surface being sufficiently smooth to permit the placing of a table cloth over said table top and use of the workbench as an ordinary table;

b) means for supporting one or more clamps comprising a skirt mounted along one or more of the edges of said table top flush with said upper surface and extending downwardly below said table top, each skirt being C-shaped in cross section with an opening into each skirt directed outwardly;

c) means comprising cross braces below said table top joining said skirts for reinforcing said table top and having horizontal, slidable rods extending outwardly from said table top for supporting power tools performing cutting operations on said table top; and d) said skirts and cross braces having spaced holes to accommodate screw members and rods for supporting and positioning tools and clamps.

2. The workbench of claim 1 in which said table top is supported by a pedestal mount.

3. The workbench of claim 1 in which said slidable rods are supported under said table top by parallel conduits into which said slidable rods extend, said conduits being set back from said skirts, one of said slidable rods having at a terminal end a mounting surface for receiving the holder of an electric drill and another of said slidable rods having at a terminal end a mounting surface for a mechanic's vise.

4. The workbench of claim 3 in which one of said conduits has a surface with holes for receiving screws for fixing both the rotational alignment and the length of the slidable rod within.

5. The workbench of claim 4 in which another conduit has a surface with perforations for receiving screws for fixing the slidable rod within.

6. The workbench of claim 5 in which said slidable rods are moveable within the conduits, are slidable out of said conduits, can be rotated through 360 degrees to place tools attached thereto at different heights above said tabletop, and can be positioned under said tabletop for hiding and storing tools.

7. The workbench of claim 1 in which said skirts are attached to extensible members permitting said skirts to be moved outwardly from said tabletop to serve as supports for larger work pieces and to hold guides used for cutting a work piece with a table saw.

* * * * *